US009105219B2

(12) United States Patent
Nishino et al.

(10) Patent No.: US 9,105,219 B2
(45) Date of Patent: Aug. 11, 2015

(54) LIGHT EMITTING ELEMENT DRIVE DEVICE, LIGHT EMITTING ELEMENT DRIVE METHOD, AND DISPLAY APPARATUS

(71) Applicant: Sony Corporation, Tokyo (JP)

(72) Inventors: Tatsuki Nishino, Kanagawa (JP); Yasushi Katayama, Kanagawa (JP); Makoto Kobori, Tokyo (JP); Yoshiki Oyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 358 days.

(21) Appl. No.: 13/780,832

(22) Filed: Feb. 28, 2013

(65) Prior Publication Data

US 2013/0249972 A1 Sep. 26, 2013

(30) Foreign Application Priority Data

Mar. 23, 2012 (JP) ..... 2012-066793

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/064* (2013.01)

(58) Field of Classification Search
CPC ..... G09G 5/10; G09G 3/3406
See application file for complete search history.

(56) References Cited

U.S. PATENT DOCUMENTS

| | | | | |
|---|---|---|---|---|
| 7,777,704 | B2 * | 8/2010 | S et al. | 345/82 |
| 2006/0238466 | A1 * | 10/2006 | Chen et al. | 345/82 |
| 2010/0194301 | A1 * | 8/2010 | Okubo | 315/224 |
| 2011/0285313 | A1 * | 11/2011 | Naito et al. | 315/294 |
| 2011/0285685 | A1 * | 11/2011 | Naito et al. | 345/211 |

FOREIGN PATENT DOCUMENTS

JP 2001-272938 10/2001

* cited by examiner

*Primary Examiner* — Douglas W Owens
*Assistant Examiner* — Pedro C Fernandez
(74) *Attorney, Agent, or Firm* — Fishman Stewart Yamaguchi PLLC

(57) ABSTRACT

A light emitting element drive device includes: a light emitting section having a light emitting element; output capacitance capable of storing power supplied to the light emitting section; a driver connected between the light emitting section and a reference potential and including a switch section whose conductive state is controlled by a pulse-like lighting signal depending on magnitude of a load current and a constant current source section connected in series to the switch section; and a power supply controller being a power supply that provides drive power to the light emitting section and including a function to adjust an output current supplied to the output capacitance. The power supply controller changes the supply amount of the output current for the light emitting section from the power supply controller based on load current information that is necessary peak power of the light emitting section.

15 Claims, 7 Drawing Sheets

LIGHT EMITTING ELEMENT DRIVE DEVICE, LIGHT EMITTING ELEMENT DRIVE METHOD, AND DISPLAY APPARATUS

BACKGROUND

The present technique relates to a drive device of a light emitting element that emits light with luminance depending on a flowing current, such as a light emitting diode (LED), a light emitting element drive method, and a display apparatus that uses the drive device and the drive method and has e.g. a non-luminous, transmissive display section.

For the backlight of a liquid crystal panel, a light emitting diode (LED) is used as the light source to replace the cold cathode fluorescent lamp (CCFL) type using a fluorescent tube.

In particular, a method of individually using the respective primary colors of red LED, green LED, and blue LED and optically performing synthetic additive color mixing to obtain white is used for television use because it easily provides favorable balance of the colors. In recent years, improvement in the color rendition of the white LED is advanced and it is coming to be frequently used for television use.

The LED has a characteristic that the luminance changes depending on the current basically, and the forward voltage varies depending on variation in the individual difference and the temperature.

Therefore, when the LED is used as the backlight of a liquid crystal panel (e.g., a liquid crystal display (LCD)), a drive device therefor is required to have the constant current characteristic to obtain certain uniform luminance.

The following drive device is known. Specifically, this drive device employs a pulse width modulation (PWM) control system in which the current flowing to an LED is turned on/off at certain timing and the luminance is adjusted based on the ratio of its on/off-period in order to stably adjust the luminance in a wide dynamic range.

As one of methods to realize this system, a method in which a switch element is inserted in series to the LED and is turned on/off at certain set timing is employed (refer to e.g. Japanese Patent Laid-open No. 2001-272938).

A system is also known in which a switch element connected in series to an LED is turned on/off by a lighting signal and PWM control of a switching transistor in a switching power supply section of e.g. a boost chopper type is carried out.

In a LCD monitor, normally control like that shown in FIG. 1 is carried out in order to suppress the influence of image lag (crosstalk) that occurs because of the low response speed of the liquid crystal at the time of image switching.

Specifically, in the LCD monitor, the on/off-timing of the backlight is controlled in association with the image switching to thereby keep display of clear images.

The on/off-timing of the backlight in this control is as follows. In a crosstalk period, the backlight is turned off as black insertion. Only in a period when crosstalk occurs as hardly as possible, the backlight is turned on to display images.

However, in this case, there is an adverse effect that the luminance of the whole backlight decreases. In order to prevent this, surging the amount of drive current (peak current amount increase) is performed to keep the brightness of images.

SUMMARY

However, a large burden is imposed on the power supply that provides power to the backlight if the amount of surge is too large. To avoid this, a power supply capable of withstanding high power needs to be set.

This increases the size and cost of the power supply. Thus, presently the current amount resulting from the surge remains at that substantially twice the original current amount.

If the amount of surge is too large, the power provided from the power supply becomes an impulse manner and therefore the current flowing to a coil and a transformer included in the power supply becomes steep, so that the occurrence of sounding (noise) is also caused.

In general, magnetic parts such as a transformer and a choke coil and a capacitor used in the power supply have the property of vibrating at the frequency of applied current/voltage in principle.

There is a need for the present technique to provide a light emitting element drive circuit, a light emitting element drive method, and a display apparatus that allow averaging of the amount of peak current supplied to a backlight, suppression of increase in the size and cost of the power supply, and suppression of generation of noise, and enable ensuring of the brightness of images and clear monitor display with low crosstalk.

According to an embodiment of the present technique, there is provided a light emitting element drive device including: a light emitting section configured to include a light emitting element that emits light with luminance depending on a flowing current; output capacitance configured to be capable of storing power supplied to the light emitting section; and a driver configured to be connected between an other end side of the light emitting section and a reference potential and include a switch section whose conductive state is controlled by a pulse-like lighting signal depending on the magnitude of a load current and a constant current source section connected in series to the switch section. The driver performs impulse driving of the light emitting section in association with the lighting signal. The light emitting element drive device further includes a power supply controller configured to be a power supply that provides drive power to one end side of the light emitting section and include a function to adjust an output current supplied to the output capacitance by a signal depending on a connection node voltage of one connection node between the other end side of the light emitting section and the reference potential. The power supply controller changes the supply amount of the output current for the light emitting section from the power supply controller based on load current information that is necessary peak power of the light emitting section in impulse driving of the light emitting section on a predetermined cycle.

According to another embodiment of the present technique, there is provided a light emitting element drive method carried out in a light emitting element drive device including: a light emitting section having a light emitting element that emits light with luminance depending on a flowing current; output capacitance capable of storing power supplied to the light emitting section; and a driver that is connected between an other end side of the light emitting section and a reference potential and includes a switch section whose conductive state is controlled by a pulse-like lighting signal depending on the magnitude of a load current and a constant current source section connected in series to the switch section. The driver performs impulse driving of the light emitting section in association with the lighting signal. The light emitting element drive device further includes a power supply controller that is a power supply that provides drive power to one end side of the light emitting section and includes a function to adjust an output current supplied to the output capacitance by a signal depending on a connection node voltage of one connection node between the other end side of the light emitting section and the reference potential. The method includes changing the supply amount of the output current for the light emitting section from the power supply controller based on load current information that is necessary peak power of the light emitting section in impulse driving of the light emitting section on a predetermined cycle in the light emitting element drive device.

According to a further embodiment of the present technique, there is provided a display apparatus including: a display section; an illuminating unit configured to have a light emitting section including a light emitting element that emits light with luminance depending on a flowing current and irradiate the display section with emitted light; and a light emitting element drive device configured to drive the light emitting element in the light emitting section. The light emitting element drive device includes: the light emitting section including the light emitting element that emits light with luminance depending on the flowing current; output capacitance capable of storing power supplied to the light emitting section; and a driver that is connected between an other end side of the light emitting section and a reference potential and includes a switch section whose conductive state is controlled by a pulse-like lighting signal depending on the magnitude of a load current and a constant current source section connected in series to the switch section. The driver performs impulse driving of the light emitting section in association with the lighting signal. The light emitting element drive device further includes a power supply controller that is a power supply that provides drive power to one end side of the light emitting section and includes a function to adjust an output current supplied to the output capacitance by a signal depending on a connection node voltage of one connection node between the other end side of the light emitting section and the reference potential. The power supply controller changes the supply amount of the output current for the light emitting section from the power supply controller based on load current information that is necessary peak power of the light emitting section in impulse driving of the light emitting section on a predetermined cycle.

According to the embodiments of the present technique, the amount of peak current supplied to a backlight can be averaged and increase in the size and cost of the power supply can be suppressed. Suppression of generation of noise is allowed and ensuring of the brightness of images and clear monitor display with low crosstalk are enabled.

DETAILED DESCRIPTION OF THE PREFERRED EMBODIMENTS

Embodiments of the present technique will be described below in association with the drawings.

The description will be made in the following order.

1. First Embodiment (first configuration example of light emitting element (LED) drive device)
2. Second Embodiment (second configuration example of light emitting element (LED) drive device)
3. Third Embodiment (third configuration example of light emitting element (LED) drive device)
4. Fourth Embodiment (configuration example of display apparatus)

1. First Embodiment

Figure 1:
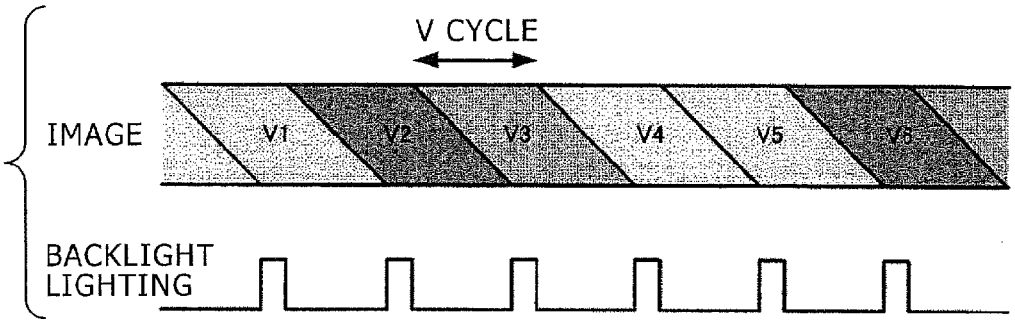
FIG. 1 is a diagram explaining timing control of turning-on/off of a backlight in a general LCD monitor.
Figure 2:
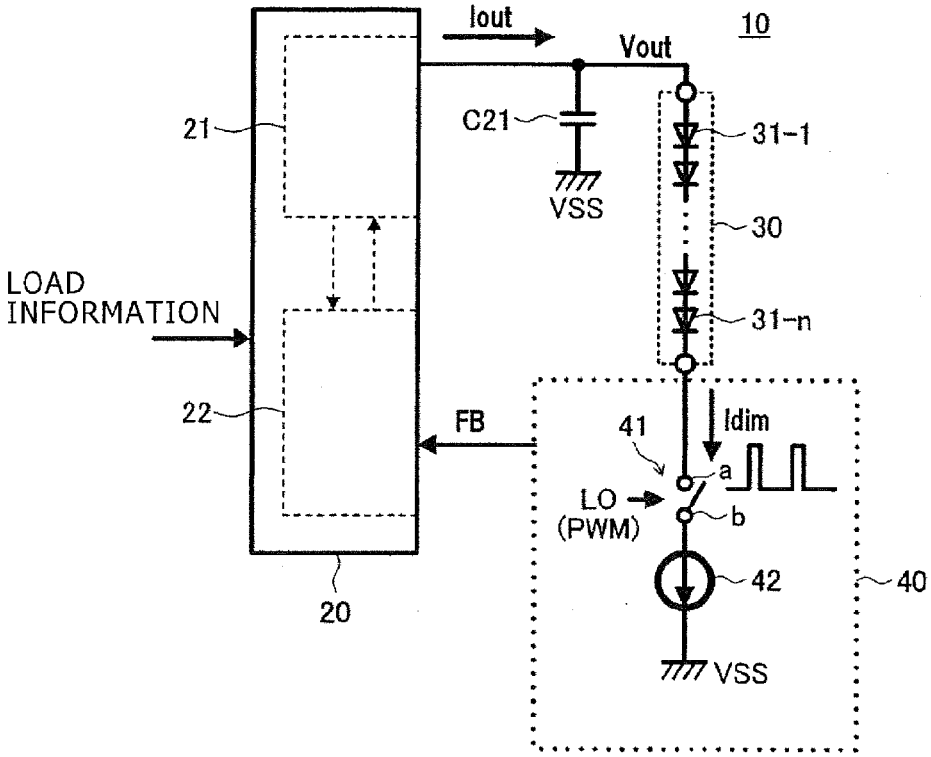
FIG. 2 is a block diagram showing a basic configuration example of a light emitting element (LED) drive device according to a first embodiment of the present technique.

FIG. 2 is a block diagram showing a basic configuration example of a light emitting element (LED) drive device according to the first embodiment.

In the present embodiment, an LED is employed as the light emitting element that is a driving target and is an electro-optical element whose luminance changes depending on the flowing current.

An LED drive device 10 according to the first embodiment has an LED power supply controller 20, a light emitting section 30 as a load, and an LED driver 40.

The light emitting section 30 is applied to e.g. the backlight of an LCD panel.

The LED power supply controller 20 includes a switching power supply section 21 of e.g. a boost type including an output capacitance C21 that is a capacitor for power storage, and a control section (DC-DC converter) 22.

The switching power supply section 21 includes, besides the output capacitance C21, e.g. a constant voltage source, an inductor, a diode, a switching transistor, and a resistive element for current detection although not shown in the diagram.

In the switching power supply section 21 having such a configuration, the switching transistor is on/off-controlled by a PWM-controlled pulse signal of the control section 22. Thereby, the switching power supply section 21 boosts a voltage VDD of the constant voltage source and supplies it to one end part of the light emitting section 30 as the load.

The LED power supply controller 20 of the present embodiment is supplied with load information used to allow the control section 22 to carry out lighting control of the light emitting section 30 as the load, and controls an output drive current Iout made by the switching power supply section 21 in the following manner.

In impulse driving of the light emitting section 30 such as a backlight used in an LCD television (LCDTV) or the like, the LED power supply controller 20 feeds forward the supply amount of the light emitting section 30 from the switching power supply section 21 based on information on the necessary peak current (power, load current) of the light emitting section 30.

In the LED power supply controller 20, a control system is employed in which an average current is always supplied with respect to e.g. an image switching cycle (vertical (V) cycle) to thereby disperse the supplied power from the LED power supply controller 20 and permit suppression of the peak current amount.

Due to this feature, cost reduction of the power supply and suppression of sounding of inductor/transformer parts and so forth are permitted. In addition, because impulse driving of the LCDTV or the like is facilitated, ensuring of the brightness of images and clear monitor display with low crosstalk are enabled.

The light emitting section 30 has an LED array obtained by connecting plural LEDs 31-1 to **31-*n*** in series.

Among the plural LEDs 31-1 to **31-*n* connected in series, the anode of the LED 31-1 on one end side is connected to the voltage output of the switching power supply section 21 and the cathode of the LED 31-*n* on the other end side is connected to the LED driver 40**.

A connection node ND11 between the cathode of the LED **31-*n* and the LED driver 40 is connected to the LED power supply controller 20** to make a feedback route.

A voltage Vs of the connection node ND11 is basically the voltage obtained by subtracting the sum ΣVf (=VF) of forward voltages Vf of all the LEDs 31-1 to **31-*n* of the light emitting section 30 from a supply voltage Vout of the switching power supply section 21**.

The light emitting section 30 is not limited to a configuration formed of plural LEDs and may be formed of a single LED.

The LED driver 40 includes a switch section 41 and a constant current source section 42.

One terminal a of the switch section 41 is connected to the cathode of the LED **31-*n* of the light emitting section 30**.

The other terminal b of the switch section 41 is connected to the constant current source section 42 and the constant current source section 42 is connected to a reference potential VSS.

The switch section 41 is kept at the on-state during a period when a PWM-controlled, pulse-like LED lighting signal LO is active, i.e. at a high level. At this time, a current Idim flows through the light emitting section 30 provided with the supply voltage Vout of the switching power supply section 21 and the respective LEDs 31-1 to **31-*n*** are lit.

The switch section 41 is kept at the off-state during a period when the LED lighting signal LO is inactive, i.e. at a low level. At this time, the current Idim does not flow through the light emitting section 30 provided with the supply voltage Vout of the switching power supply section 21 and the respective LEDs 31-1 to **31-*n*** are turned off.

A more detailed description will be made below about control of the output drive current Tout in the LED power supply controller 20 of the present embodiment in association with FIGS. 2 to 6C.

In FIG. 2, the LEDs 31-1 to **31-*n* are used for the light emitting section 30** as e.g. the backlight of an LCD.

FIG. 2 shows the LED driver 40 that causes the current flowing through the LEDs 31 (−1 to n) to be an impulse-like load and the LED power supply controller 20 that supplies the current to the LEDs 31.

Figure 3:
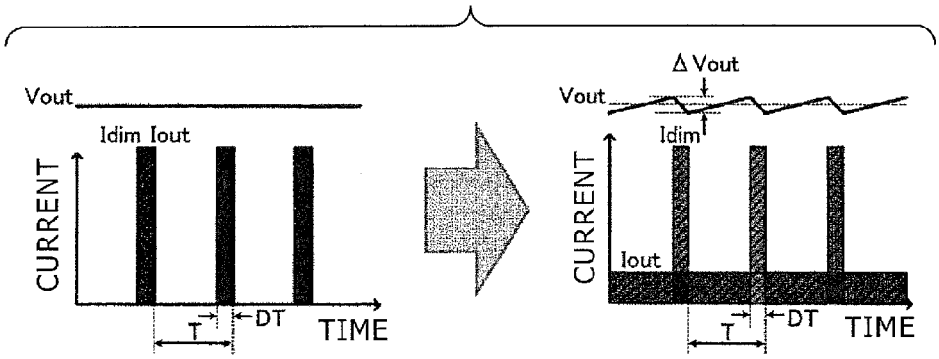
FIG. 3 is a diagram explaining a method in which a current from an LED power supply controller continues to be supplied to output capacitance to charge it also in an interval when a load is in the off-state and thereafter the output capacitance is rapidly discharged.

FIG. 3 is a diagram explaining a method in which the current from the LED power supply controller continues to be supplied to the output capacitance to charge it also in an interval when the load is in the off-state and thereafter the output capacitance is rapidly discharged.

Figure 4:
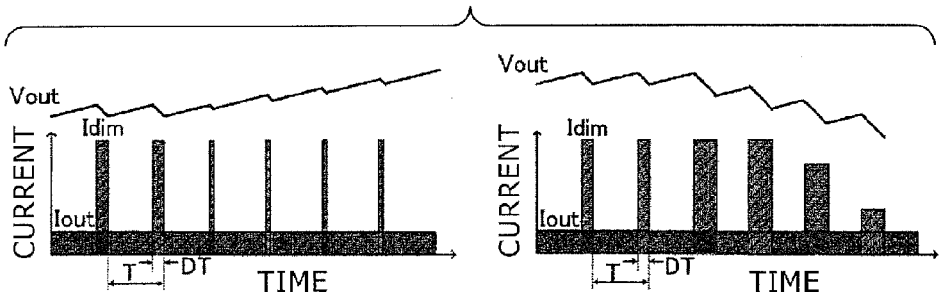
FIG. 4 is a diagram explaining that output variation occurs in the method of FIG. 3.

FIG. 4 is a diagram explaining that output variation occurs in the method of FIG. 3.

Figure 5:
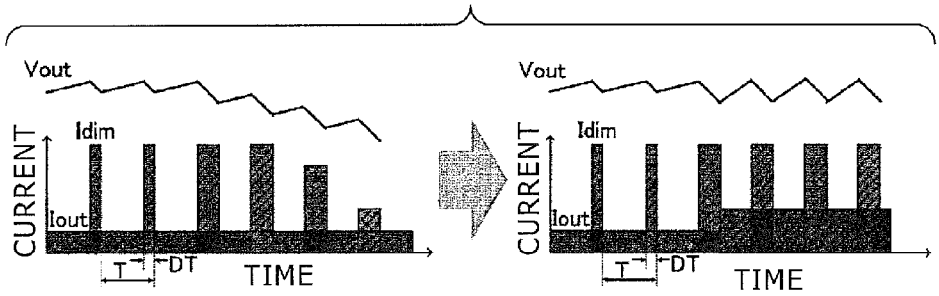
FIG. 5 is a diagram explaining a method in which the amount of supplied current is changed based on information on the magnitude of a next load current at a stage previous to switching of the load current (off-period previous to switching of the load)

FIG. 5 is a diagram explaining a method in which the amount of supplied current is changed based on information on the magnitude of a next load current at a stage previous to switching of the load current (off-period previous to switching of the load).

Figure 6A:
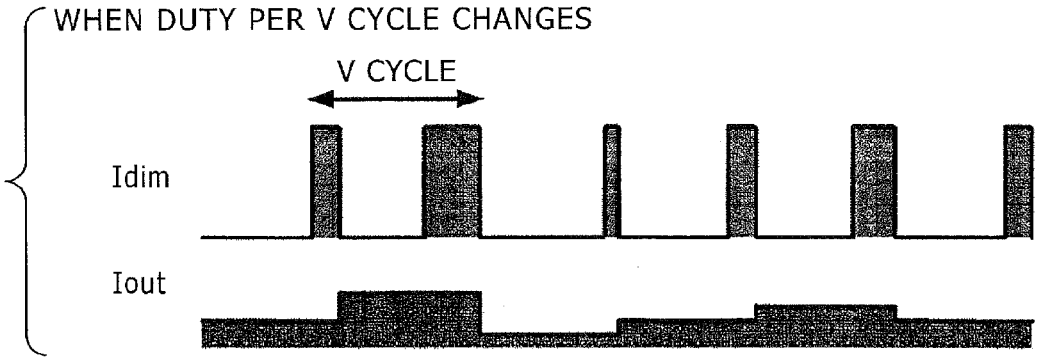
FIGS. 6A to 6C are diagrams showing forms of the change in the load current when the method of FIG. 5 is employed.
Figure 6B:
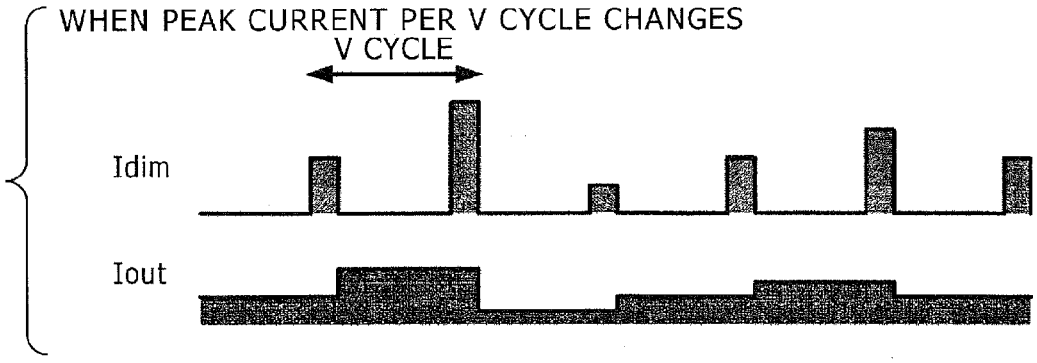
Figure 6C:
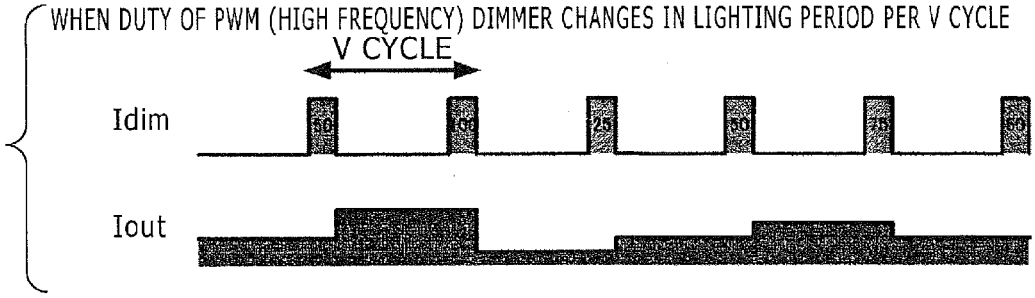

FIGS. 6A to 6C are diagrams showing forms of the change in the load current when the method of FIG. 5 is employed. FIG. 6A shows the case in which the duty per V cycle changes. FIG. 6B shows the case in which the peak current per V cycle changes. FIG. 6C shows the case in which the duty of a PWM (high frequency) dimmer changes in a lighting period per V cycle.

As described above, the LED driver 40 turns on/off the switch section in association with the duty of the PWM pulse and the current Idim flows through the LEDs 31-1 to **31-*n*** in a pulse manner.

In a normal case, the same pulse current as Idim should be supplied as the drive current Iout from the LED power supply controller 20.

However, as shown in FIG. 3, the current from the LED power supply controller 20 continues to be supplied to the output capacitance to charge it also in the interval when the load is in the off-state, and thereafter the output capacitance is rapidly discharged.

In this operation, in contrast to the pulse-like current Idim, a constant current is supplied as the drive current Iout so that the average current per V cycle may be equal. This provides stable operation and can suppress the peak current of the drive current Iout.

However, if a change occurs in the power of the load in this state, output variation occurs as shown in FIG. 4. Delay of the feedback attributed to the long cycle of the current pulse increases the variation in the output voltage Vout and thus the load current is affected.

As a countermeasure against this, in the present embodiment, as shown in FIG. 5, Iout as the amount of supplied current is changed based on information on the magnitude of the next load current at the stage previous to switching of the load current (off-period previous to switching of the load).

Due to this feature, only change of the ripple voltage associated with the charge/discharge of the output capacitance appears as the variation in the voltage Vout. Therefore, the load current also becomes constant and stable operation is achieved.

Various cases exist regarding the change in the load current. FIGS. 6A to 6C show examples thereof.

Stable operation is enabled by changing and averaging the drive current Tout in association with the change in the load current for all the cases of FIGS. 6A to 6C.

For example, the current Iout is so averaged as to be in a step manner in the case in which the duty gradually becomes higher as shown in FIG. 6A, the case in which the peak current gradually becomes larger as shown in FIG. 6B, and the case in which the duty of the PWM dimmer gradually becomes higher as shown in FIG. 6C.

As described above, the following advantageous effects can be achieved according to the present first embodiment.

In the related art, if the amount of power supply surge is too large, a large burden is imposed on the power supply that provides power to the backlight.

In contrast, in the LED drive device 10 of the present embodiment, the amount of peak current supplied to the light emitting section 30 such as a backlight is averaged to become smaller. This can realize reduction in the cost and area of the power supply.

In general, due to that the power provided from the power supply becomes an impulse manner, the current flowing to a coil and a transformer included in the power supply becomes steep, which also causes the occurrence of sounding. However, the present system prevents the current from steeply changing and therefore provides an effect as a countermeasure against noise (sounding).

The feed-forward control as a configuration example to realize this configuration can instantaneously react to a load response and thus can enable stable lighting of the light emitting section 30 such as a backlight.

In view of the image, bright, clear monitor display with low crosstalk is enabled because impulse driving of an LCD with a large surge, which has been difficult to realize until now, can be easily realized.

As above, to realize the embodiment of the present technique, the LED power supply controller that changes the output current Iout to be supplied in advance based on information on the magnitude of the load current is used. As a specific example thereof, a DC-DC converter including a built-in multiplier as the feed-forward function can be exemplified.

The multiplier functions as a feed-forward section (voltage changer) that changes an error voltage depending on load current information.

2. Second Embodiment

Figure 7:
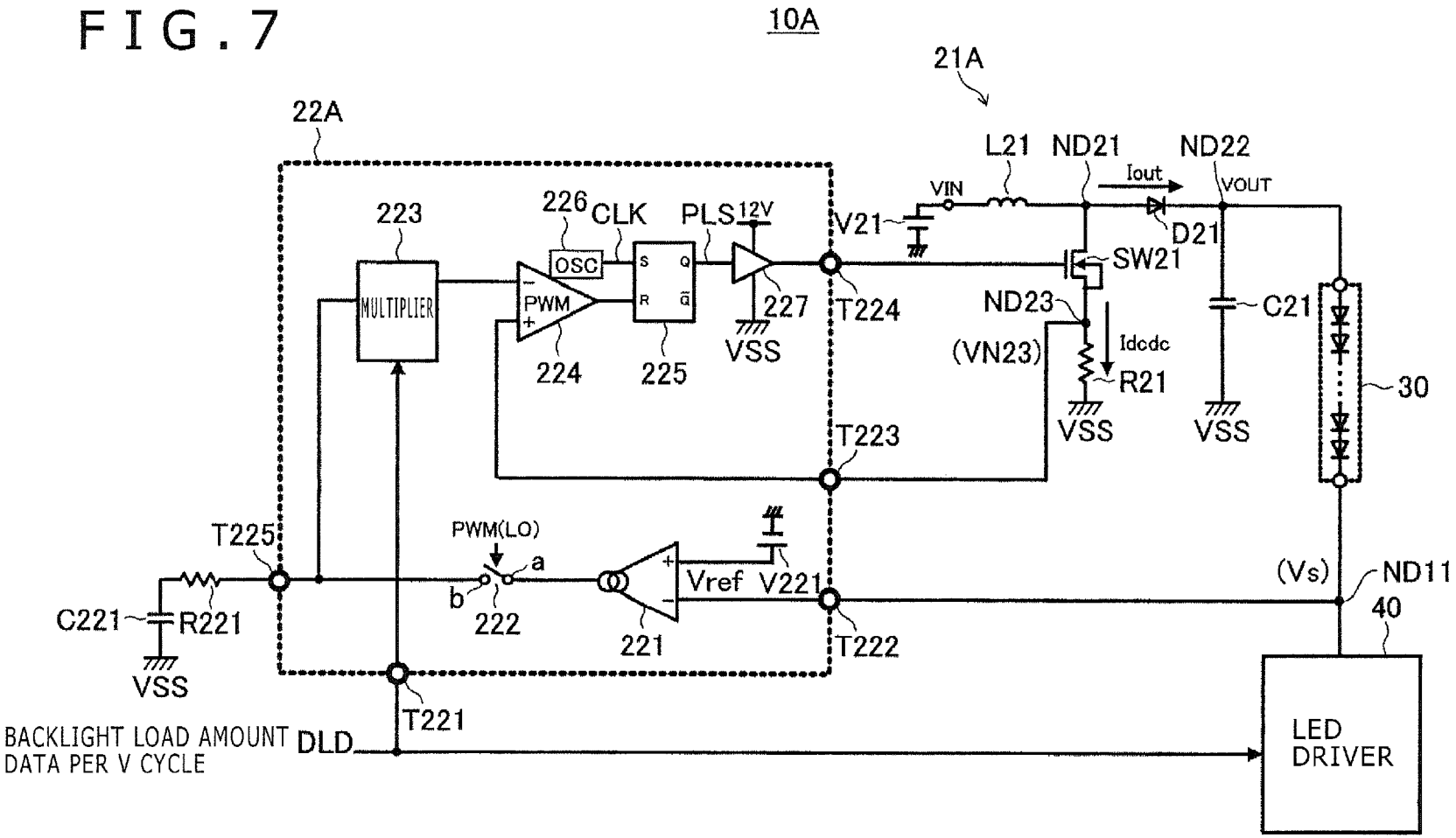
FIG. 7 is a block diagram showing a configuration example of a light emitting element (LED) drive device according to a second embodiment of the present technique.

FIG. 7 is a circuit diagram showing a configuration example of a light emitting element (LED) drive device according to the second embodiment.

FIG. 7 shows a specific example of an LED drive device 10A including a DC-DC converter having a built-in multiplier as the feed-forward section.

In FIG. 7, the same constituent part as that in the configuration of FIG. 2 is represented by the same symbol.

The LED drive device 10A of FIG. 7 has an LED power supply controller 20A including a switching power supply section 21A of a boost chopper type and a DC-DC converter 22A as a control section. The LED drive device 10A further has the light emitting section 30 as a load and the LED driver 40 including the switch section 41 and the constant current source section 42.

The switching power supply section 21A has a constant voltage source V21, an inductor L21, a diode D21, output capacitance C21 that is a capacitor for power storage, a switching transistor SW21, a resistive element R21 for current detection, and nodes ND21 to ND23.

One end of the inductor L21 is connected to the constant voltage source V21 of the voltage VDD and the other end is connected to the node ND21. The anode of the diode D21 is connected to the node ND21 and the cathode is connected to the node ND22. One terminal (electrode) of the output capacitance (capacitor) C21 is connected to the node ND22 and the other terminal (electrode) is connected to the reference potential VSS (e.g. ground potential).

The node ND22 is connected, as a voltage output node of the switching power supply section 21A, to one end part of the light emitting section 30 as the load.

The switching transistor SW21 is formed of e.g. a negative channel metal oxide semiconductor (NMOS) transistor, which is an n-channel field effect transistor. The drain of the switching transistor SW21 is connected to the node ND21 and the source is connected to one end of the resistive element R21. The node ND23 is formed by this connection node between the source and one end of the resistive element R21. The other end of the resistive element R21 is connected to the reference potential VSS.

In such a switching power supply section 21A, the switching transistor SW21 is on/off-controlled by a PWM-controlled pulse signal of the DC-DC converter (control section) 22A. Thereby, the switching power supply section 21A boosts the voltage VDD of the constant voltage source V21 and supplies it to one end part of the light emitting section 30 as the load.

The DC-DC converter (control section) 22A has a feedback amplifier 221, a hold switch (SWhold) 222, and a multiplier (arithmetic section) 223 as a feed-forward functional section.

The DC-DC converter 22A has a comparator 224, a flip-flop (FF) 225 for pulse output, a clock generator 226, a driver 227, a reference voltage source V221, a capacitor C221, a resistive element R221, and terminals T221 to T225.

A pulse converter is formed by the comparator 224, the FF 225, and the clock generator 226.

The terminal T221 is connected to a supply line of load amount data DLD of the light emitting section 30 per V cycle and is connected to the input part of the multiplier 223 for the load amount data DLD.

The terminal T222 is connected to the connection node ND11 between the cathode of the LED 31-*n* of the light emitting section 30 and the switch section 41 of the LED driver 40, and the terminal T223 is connected to the node ND23 in the switching power supply section 21A.

The terminal T224 is connected to the gate of the switching transistor SW21.

The resistive element R221 and the capacitor C221 are connected in series between the terminal T225 and the reference potential VSS.

A non-inverting input terminal (+) of the feedback amplifier 221 is connected to the reference voltage source V221 and an inverting input terminal (−) is connected to the terminal T222, to which the voltage Vs of the node ND11 is supplied.

The feedback amplifier 221 amplifies the voltage difference between the voltage Vs of the node ND11 and a reference voltage Vref and outputs an error voltage Verr to the hold switch 222. This error voltage Verr is held by the capacitor C221 in the off-period of the hold switch 222.

A terminal a of the hold switch 222 is connected to the output of the feedback amplifier 221 and a terminal b is connected to the terminal T225 and one input of the multiplier 223.

In the hold switch 222, electrical conduction is made between the terminal a and the terminal b when the LED lighting signal LO as a PWM pulse signal is active and electrical conduction is not made when the LED lighting signal LO is inactive.

When being in the conductive state, the hold switch 222 causes the error voltage Verr by the feedback amplifier 221 to be input to the multiplier 223.

The error voltage Verr, which is the output of the feedback amplifier 221, is input to the multiplier 223 and the multiplier 223 changes this error voltage Verr in association with the load amount data DLD for feed-forward, input via the terminal T221.

The DC-DC converter 22A of the present embodiment is in a peak current mode and the current Iout supplied to the output capacitance C21 changes depending on the magnitude of a peak current Idcdc at the time of switching of the DC-DC converter 22A.

In the present embodiment, the peak current Idcdc of the DC-DC converter 22A is controlled based on the output value of the multiplier 223. This enables the current amount of the current Iout supplied to the output capacitance C21 to be changed by a feed-forward input.

A non-inverting input terminal (+) of the comparator 224 is connected to the terminal T223 connected to the node ND23 of the switching power supply section 21A and an inverting input terminal (−) is connected to the output of the multiplier 223.

The comparator 224 compares the error voltage Verr, which is the output of the multiplier 223 and changes depending on the load amount data DLD, with a voltage VN23 of the node ND23 (voltage resulting from conversion of the current Idcdc by the resistive element R21), and outputs the comparison result to the FF 225.

The comparator 224 outputs a low-level signal when the voltage VN23 of the node ND23 is lower than the error voltage Verr and outputs a high-level signal when the voltage VN23 is higher.

The FF 225 is configured by a set-reset (RS) FF.

The FF 225 outputs, from a terminal Q, a pulse depending on a clock CLK supplied to a set terminal S and the level of the output of the comparator 224 supplied to a reset terminal R.

The FF 225 outputs, to the driver 227, a signal PLS with the pulse width depending on the difference between the voltage Vs of the node ND11 and the reference voltage Vref as a result.

This pulse signal PLS is supplied to the gate of the switching transistor SW21 via the driver 227. In the switching power supply section 21A, boost operation is carried out by on/off-control of this switching transistor SW21.

A feedback section of the DC-DC converter 22A of the present embodiment samples and holds the voltage Vs when the LEDs are in the ON-state from the cathode side of the LEDs of the light emitting section 30. The feedback amplifier 221 should be configured by an amplifier whose response is sufficiently slow with respect to the PWM cycle (sampling cycle).

The output of this feedback amplifier 221 is input to the multiplier 223 via the hold switch 222 and the output of the multiplier 223 is changed in association with the load amount data DLD, which is the input signal for feed-forward.

The DC-DC converter 22A is in the peak current mode and the current Tout supplied to the output capacitance C21 changes depending on the magnitude of the peak current Idcdc at the time of switching of the DC-DC converter 22A.

In the present embodiment, the peak current Idcdc of the DC-DC converter 22A is controlled based on the output value of the multiplier 223. Thus, the current amount of the current Iout supplied to the output capacitance C21 can be changed by the feed-forward input.

Information on the magnitude of a next LED current is input as this feed-forward input in the period when the LED current is in the off-state to change the output of the multiplier 223. Thereby, the current Iout, which is the power supplied to the output capacitance C21, is changed in advance.

Thereafter, the current for the LEDs is rapidly discharged from the output capacitance C21. This allows stable supply irrespective of load variation of the LEDs.

Operation by the above-described configuration will be described below with focus on the control operation of the DC-DC converter (control section) 22A.

When the LED lighting signal LO is inactive, i.e. at the low level, the switch section 41 of the LED driver 40 is kept at the off-state. At this time, the current Idim does not flow through the light emitting section 30 provided with the supply voltage Vout of the switching power supply section 21A and the respective LEDs 31-1 to 31-*n* are not lit.

When the LED lighting signal LO is at the low level, the hold switch 222 of the DC-DC converter (control section) 22A is kept at the off-state.

If the LED lighting signal LO becomes active, i.e. rises up to the high level, the switch section 41 of the LED driver 40 is turned on. The switch section 41 is kept at the on-state during the period when the pulse-like LED lighting signal LO is active, i.e. at the high level.

At this time, the current Idim flows through the light emitting section 30 provided with the supply voltage Vout of the switching power supply section 21A and the respective LEDs 31-1 to 31-*n* are lit.

During the period when the switch section 41 is in the on-state, the voltage Vs of the connection node ND11 between the light emitting section 30 and the switch section 41 is supplied to the feedback amplifier 221 of the DC-DC converter 22A. This voltage Vs is basically the voltage obtained by subtracting the sum ΣVf (=VF) of the forward voltages Vf of all the LEDs 31-1 to 31-*n* of the light emitting section 30 from the supply voltage Vout of the switching power supply section 21A.

When the LED lighting signal LO is switched to the high level, the hold switch 222 of the DC-DC converter 22A is turned on.

In the feedback amplifier 221, the voltage Verr obtained by amplifying the voltage difference between the voltage Vs of the node ND11 and the reference voltage Vref is output to the hold switch 222.

At this time, the hold switch 222 is in the conductive state and thus the voltage Verr by the feedback amplifier 221 is supplied to the multiplier 223.

The error voltage Verr, which is the output of the feedback amplifier 221, is input to the multiplier 223. In the multiplier 223, this error voltage Verr is changed in association with the load amount data DLD for feed-forward, input via the terminal T221, and this error voltage Verr is supplied to the comparator 224.

In the comparator 224, the error voltage Verr is compared with the voltage VN23 of the node ND23 and the comparison result is output to the FF 225. In the comparator 224, a low-level signal is output when the voltage VN23 of the node ND23 is lower than the error voltage Verr and a high-level signal is output when the voltage VN23 is higher.

In the FF 225, the pulse depending on the clock CLK supplied to the set terminal S and the level of the output of the comparator 224 supplied to the reset terminal R is output from the terminal Q to the driver 227. In the FF 225, the signal PLS with the pulse width depending on the difference between the voltage Vs of the node ND11 and the reference voltage Vref is output to the driver 227 as a result.

This pulse signal PLS is supplied to the gate of the switching transistor SW21 via the driver 227. In the switching power supply section 21A, stable boost operation is carried out by on/off-control of this switching transistor SW21.

The DC-DC converter 22A of the present embodiment is in the peak current mode and the current Iout supplied to the output capacitance C21 changes depending on the magnitude of the peak current Idcdc at the time of switching of the DC-DC converter 22A.

In the present embodiment, the peak current Idcdc of the DC-DC converter 22A is controlled based on the output value of the multiplier 223. Thus, the current amount of the current iout supplied to the output capacitance C21 can be changed by the feed-forward input.

In this manner, in the switching power supply section 21A, the switching transistor SW21 is on/off-controlled by the PWM-controlled pulse signal of the DC-DC converter 22A to boost the voltage VDD of the constant voltage source V21 and supply it to one end part of the light emitting section 30 as the load.

According to the second embodiment, the same advantageous effects as those of the above-described first embodiment can be achieved.

In the LED drive device 10A of the second embodiment, the amount of peak current supplied to the light emitting section 30 such as a backlight is averaged to become smaller. This can realize reduction in the cost and area of the power supply.

In general, due to that the power provided from the power supply becomes an impulse manner, the current flowing to a coil and a transformer included in the power supply becomes steep, which also causes the occurrence of sounding. However, the present system prevents the current from steeply changing and therefore provides an effect as a countermeasure against noise (sounding).

The feed-forward control as a configuration example to realize this configuration can instantaneously react to a load response and thus can enable stable lighting of the light emitting section 30 such as a backlight.

In view of the image, bright, clear monitor display with low crosstalk is enabled because impulse driving of an LCD with a large surge, which has been difficult to realize until now, can be easily realized.

3. Third Embodiment

Figure 8:
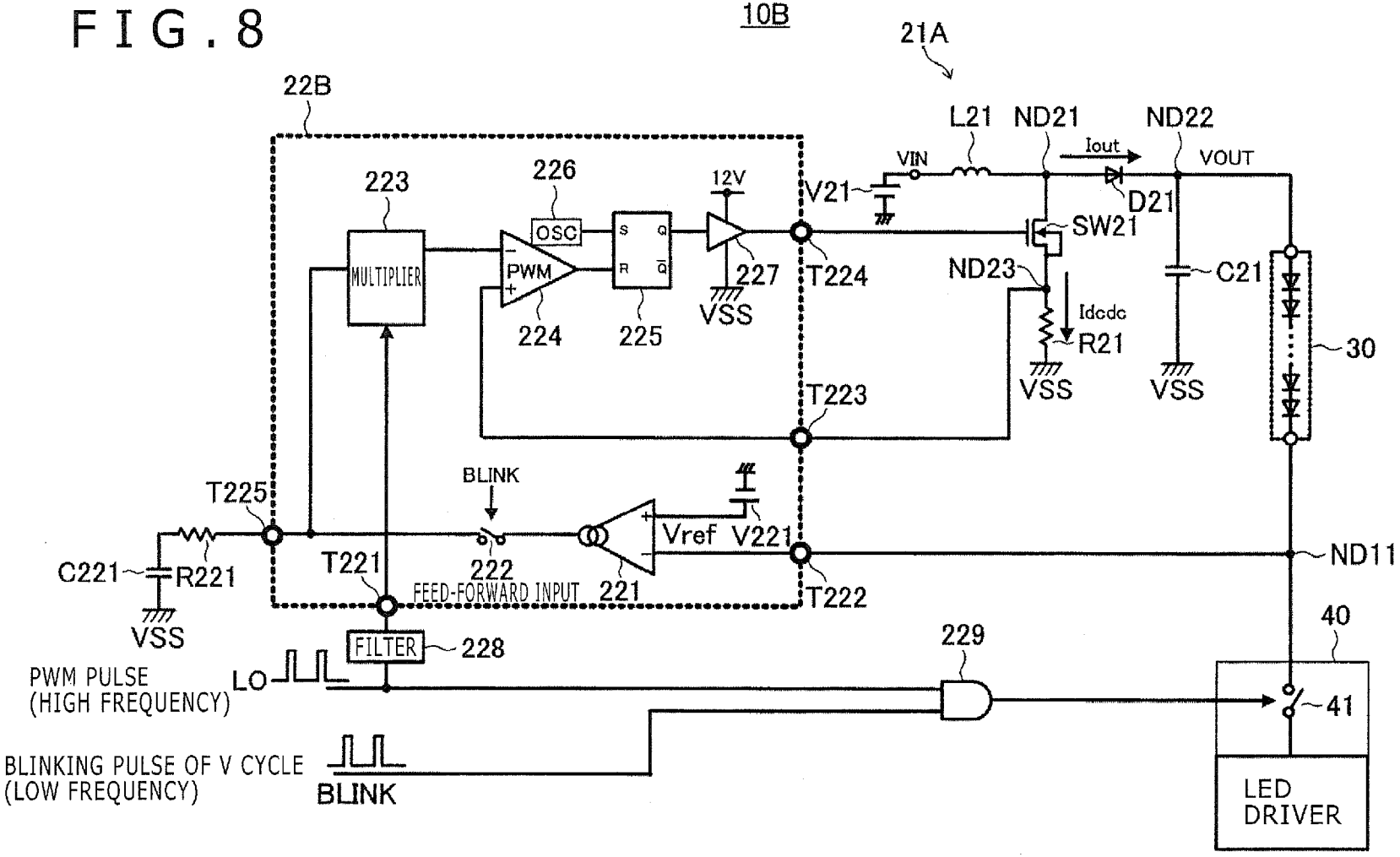
FIG. 8 is a block diagram showing a configuration example of a light emitting element (LED) drive device according to a third embodiment of the present technique.

FIG. 8 is a block diagram showing a configuration example of a light emitting element (LED) drive device according to the third embodiment.

The difference of an LED drive device 10B according to the third embodiment from the LED drive device 10A according to the second embodiment is as follows.

The LED drive device 10B according to the present third embodiment is a configuration example of a case in which a signal (blinking signal) BLINK to light the light emitting section 30 such as a backlight according to the V cycle is separated from the PWM lighting signal LO of the backlight for brightness adjustment.

When the low-frequency blinking signal BLINK is separated from the lighting signal LO, which is a high-frequency PWM signal, as shown in FIG. 8, the configuration can be made in the following manner.

The lighting signal LO, which is a high-frequency PWM signal, is smoothed and the analog value thereof is input to the multiplier 223 as a feed-forward input. Thereby, a feed-forward circuit can be easily realized.

In the configuration of FIG. 8, the lighting signal LO, which is a PWM pulse signal, is input to the multiplier 223 via a filter 228 and through the terminal T221.

In a DC-DC converter 22B in FIG. 8, the hold switch 222 is turned on/off by the low-frequency blinking signal BLINK.

On/off-control of the switch section 41 of the LED driver 40 is carried out by a signal obtained by performing the logical AND between the lighting signal LO and the blinking signal BLINK by an AND gate 229.

The other configuration of the LED drive device 10B of the third embodiment is the same as that of the second embodiment.

According to the third embodiment, the same advantageous effects as those of the above-described first and second embodiments can be achieved.

The LED drive devices 10, 10A, and 10B of the embodiments are suitable for e.g. a transmissive liquid crystal display apparatus having a backlight device.

4. Fourth Embodiment

As a fourth embodiment of the present technique, a liquid crystal display apparatus using an LED backlight to which the LED drive devices of FIGS. 2, 7, and 8 can be applied will be described below.

Figure 9:
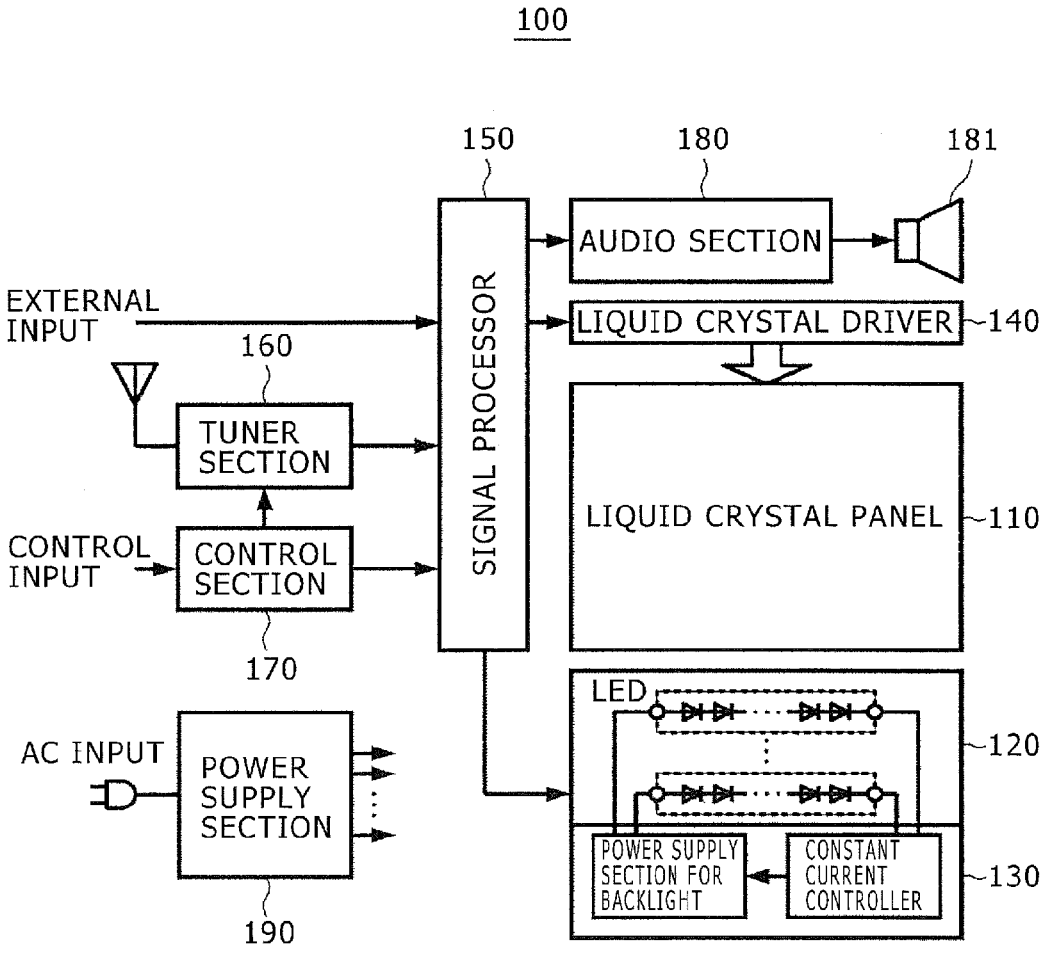
FIG. 9 is a block diagram showing a configuration example of a liquid crystal display apparatus according to a fourth embodiment of the present technique.

FIG. 9 is a block diagram showing a configuration example of the liquid crystal display apparatus according to the fourth embodiment.

As shown in FIG. 9, a liquid crystal display apparatus 100 has a transmissive liquid crystal display panel (LCD panel) 110, a backlight device 120 as an illuminating unit provided on the backside of the LCD panel 110, an LED drive device 130, and a liquid crystal driver (panel drive circuit) 140.

The liquid crystal display apparatus 100 has a signal processor 150, a tuner section 160, a control section 170, an audio section 180 including a speaker 181, and a power supply section 190.

Figure 10:
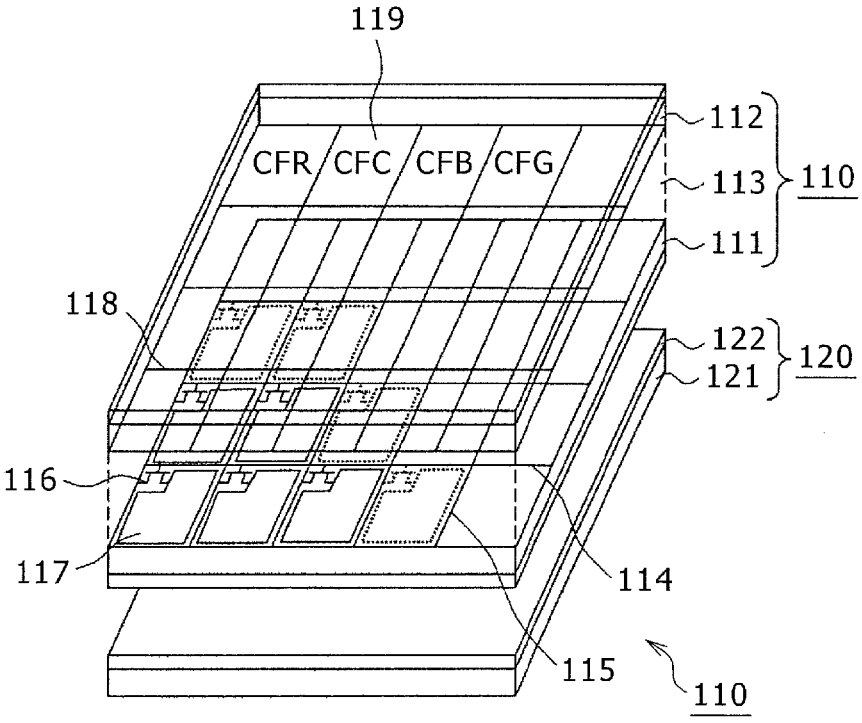
FIG. 10 is a diagram showing a configuration example of a transmissive LCD panel.

FIG. 10 is a diagram showing a configuration example of the transmissive LCD panel 110.

This transmissive LCD panel 110 has a TFT substrate 111 and a counter electrode substrate 112 disposed opposed to each other, and also has a liquid crystal layer 113, which is obtained by enclosing e.g. a twisted nematic (TN) liquid crystal, provided between the substrates.

On the TFT substrate 111, signal lines 114 and scan lines 115 disposed in a matrix manner and thin film transistors 116 as switching elements and pixel electrodes 117 disposed at the intersections of these lines are formed.

The thin film transistors 116 are sequentially selected by the scan lines 115 and write a video signal supplied from the signal lines 114 to the corresponding pixel electrodes 117. A counter electrode 118 and a color filter 119 are formed on an inside surface of the counter electrode substrate 112.

In the liquid crystal display apparatus 100, the transmissive LCD panel 110 having such a configuration is sandwiched by two polarizing plates and driving is performed by an active-matrix system in a state in which white light is emitted from the backside by the backlight device 120. Thereby, desired full-color video display is obtained.

The backlight device 120 includes a light source 121 and a wavelength selection filter 122.

The light source 121 includes plural LED arrays arranged. The LED arrays form the light emitting section 30, which is the driving target of the first, second, and third embodiments.

The backlight device 120 irradiates the LCD panel 110 with light emitted from the light source 121 from the backside via the wavelength selection filter 122.

As the backlight device 120 shown in FIG. 10, a direct-lit backlight device that is disposed on the backside of the transmissive LCD panel 110 and illuminates the LCD panel 110 from directly beneath the back surface of the LCD panel 110 is shown as one example.

As described above, the light source (light emitting section) 121 of the backlight device 120 employs plural LEDs connected in series as the light emission source.

In the light source 121 of the backlight device 120, LEDs arranged along a screen horizontal direction are connected in series and plural LED arrays (LED groups) connected in series along the horizontal direction are formed.

The backlight device 120 having such a configuration is driven by the LED drive device 130.

As the LED drive device 130, the above-described LED drive devices of FIGS. 2, 7, and 8 can be used.

In FIG. 9, the configuration is so shown that the whole of the light source 121 is driven by the LED drive device 130. However, it is also possible to employ a configuration in which an independent LED drive device is provided for each one of the LED arrays connected in series along the horizontal direction.

The liquid crystal driver 140 includes an X driver circuit, a Y driver circuit, and so forth and drives the LCD panel 110 by e.g. red-green-blue (RGB) separate signals supplied to the X driver circuit and the Y driver circuit by the signal processor 150.

Thereby, video according to the RGB separate signals is displayed.

The signal processor 150 executes signal processing such as chroma processing for a video signal input from the tuner section 160 or the external and converts the signal from a composite signal to RGB separate signals suitable for driving of the LCD panel 110 to supply it to the panel drive circuit 140.

The signal processor 150 extracts an audio signal from the input signal and makes the speaker 181 output sound through the audio section 180.

To the liquid crystal display apparatus 100 having such a configuration, the LED drive devices 10, 10A, and 10B of FIGS. 2, 7, and 8 are applied.

Due to that the amount of peak current supplied to the backlight device 120 is averaged to become smaller, reduction in the cost and area of the power supply can be realized.

The amount of change in a current IL flowing through the inductor L21 at timing immediately after LED lighting of the backlight device 120 and at the time of LED turning-off is small.

Due to this feature, because the amount of change in the current IL flowing through the inductor L21 and so forth is suppressed to a small value, generation of noise (sounding) audible by the human ear from these parts can be deterred.

The feed-forward control can instantaneously react to a load response and thus can enable stable lighting of the backlight device 120.

In view of the image, bright, clear monitor display with low crosstalk is enabled because impulse driving of an LCD with a large surge, which has been difficult to realize until now, can be easily realized.

The present technique can employ the following configurations.

(1) A light emitting element drive device including:

a light emitting section configured to include a light emitting element that emits light with luminance depending on a flowing current;

output capacitance configured to be capable of storing power supplied to the light emitting section;

a driver configured to be connected between an other end side of the light emitting section and a reference potential and include a switch section whose conductive state is controlled by a pulse-like lighting signal depending on magnitude of a load current and a constant current source section connected in series to the switch section, the driver performing impulse driving of the light emitting section in association with the lighting signal; and a power supply controller configured to be a power supply that provides drive power to one end side of the light emitting section and include a function to adjust an output current supplied to the output capacitance by a signal depending on a connection node voltage of one connection node between the other end side of the light emitting section and the reference potential, in which the power supply controller changes the supply amount of the output current for the light emitting section from the power supply controller based on load current information that is necessary peak power of the light emitting section in impulse driving of the light emitting section on a predetermined cycle.

(2) The light emitting element drive device according to the above-described (1), in which the power supply controller changes the output current to be supplied based on information on magnitude of a next load current at a stage previous to switching of the load current.

(3) The light emitting element drive device according to the above-described (1) or (2), in which the power supply controller supplies the output current averaged with respect to an image switching cycle.

(4) The light emitting element drive device according to the above-described (3), in which the power supply controller supplies the output current averaged with respect to the image switching cycle when duty per image switching cycle changes in the load current.

(5) The light emitting element drive device according to the above-described (3), in which the power supply controller supplies the output current averaged with respect to the image switching cycle when a peak current per image switching cycle changes in the load current.

(6) The light emitting element drive device according to the above-described (3), in which the power supply controller supplies the output current averaged with respect to the image switching cycle when duty of a high-frequency dimmer in a lighting period per image switching cycle changes in the load current.

(7) The light emitting element drive device according to any one of the above-described (1) to (6), in which the power supply controller includes a switching power supply section that includes a switch element allowing adjustment of a flowing peak current according to a signal to a control terminal and changes the output current depending on magnitude of the peak current to supply output power according to the adjustment to one end side of the light emitting section, and a control section, the control section including a feedback amplifier that obtains an error voltage between the connection node voltage of one connection node between the other end side of the light emitting section and the reference potential and a reference voltage set in advance, a feed-forward section that changes the error voltage obtained by the feedback amplifier in association with the load current information supplied, and a pulse converter that outputs, the control terminal of the switch element, a signal with a pulse width yielding the peak current that flows through the switch element and is in proportional to the error voltage changed by the feed-forward section.

(8) The light emitting element drive device according to the above-described (7), in which the pulse-like lighting signal supplied to the switch section of the driver includes a blinking signal to light the light emitting section according to the predetermined cycle, and a lighting signal to adjust brightness, and the feed-forward section of the power supply controller changes the error voltage obtained by the feedback amplifier according to the lighting signal supplied to adjust brightness.

(9) A light emitting element drive method carried out in a light emitting element drive device having a light emitting section including a light emitting element that emits light with luminance depending on a flowing current, output capacitance capable of storing power supplied to the light emitting section, a driver that is connected between an other end side of the light emitting section and a reference potential and includes a switch section whose conductive state is controlled by a pulse-like lighting signal depending on magnitude of a load current and a constant current source section connected in series to the switch section, the driver performing impulse driving of the light emitting section in association with the lighting signal, and a power supply controller that is a power supply that provides drive power to one end side of the light emitting section and includes a function to adjust an output current supplied to the output capacitance by a signal depending on a connection node voltage of one connection node between the other end side of the light emitting section and the reference potential, the method including changing the supply amount of the output current for the light emitting section from the power supply controller based on load current information that is necessary peak power of the light emitting section in impulse driving of the light emitting section on a predetermined cycle in the light emitting element drive device.

(10) The light emitting element drive method according to the above-described (9), in which the output current to be supplied is changed based on information on magnitude of a next load current at a stage previous to switching of the load current.

(11) The light emitting element drive method according to the above-described (9) or (10), in which the output current averaged with respect to an image switching cycle is supplied.

(12) The light emitting element drive method according to the above-described (11), in which the output current averaged with respect to the image switching cycle is supplied when duty per image switching cycle changes in the load current.

(13) The light emitting element drive method according to the above-described (11), in which the output current averaged with respect to the image switching cycle is supplied when a peak current per image switching cycle changes in the load current.

(14) The light emitting element drive method according to the above-described (11), in which the output current averaged with respect to the image switching cycle is supplied when duty of a high-frequency dimmer in a lighting period per image switching cycle changes in the load current:

(15) A display apparatus including:

a display section;

an illuminating unit configured to have a light emitting section including a light emitting element that emits light with luminance depending on a flowing current and irradiate the display section with emitted light; and a light emitting element drive device configured to drive the light emitting element in the light emitting section, in which the light emitting element drive device has the light emitting section including the light emitting element that emits light with luminance depending on the flowing current, output capacitance capable of storing power supplied to the light emitting section, a driver that is connected between an other end side of the light emitting section and a reference potential and includes a switch section whose conductive state is controlled by a pulse-like lighting signal depending on magnitude of a load current and a constant current source section connected in series to the switch section, the driver performing impulse driving of the light emitting section in association with the lighting signal, and a power supply controller that is a power supply that provides drive power to one end side of the light emitting section and includes a function to adjust an output current supplied to the output capacitance by a signal depending on a connection node voltage of one connection node between the other end side of the light emitting section and the reference potential, the power supply controller changing the supply amount of the output current for the light emitting section from the power supply controller based on load current information that is necessary peak power of the light emitting section in impulse driving of the light emitting section on a predetermined cycle.

The present disclosure contains subject matter related to that disclosed in Japanese Priority Patent Application JP 2012-066793 filed in the Japan Patent Office on Mar. 23, 2012, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A light emitting element drive device comprising:

a light emitting section configured to include a light emitting element that emits light with luminance depending on a flowing current;

output capacitance configured to be capable of storing power supplied to the light emitting section;

a driver configured to be connected between an other end side of the light emitting section and a reference potential and include a switch section whose conductive state is controlled by a pulse-like lighting signal depending on magnitude of a load current and a constant current source section connected in series to the switch section, the driver performing impulse driving of the light emitting section in association with the lighting signal; and a power supply controller configured to be a power supply that provides drive power to one end side of the light emitting section and include a function to adjust an output current supplied to the output capacitance by a signal depending on a connection node voltage of one connection node between the other end side of the light emitting section and the reference potential, wherein the power supply controller changes the supply amount of the output current for the light emitting section from the power supply controller based on load current information that is necessary peak power of the light emitting section in impulse driving of the light emitting section on a predetermined cycle.

2. The light emitting element drive device according to claim 1, wherein the power supply controller changes the output current to be supplied based on information on magnitude of a next load current at a stage previous to switching of the load current.

3. The light emitting element drive device according to claim 1, wherein the power supply controller supplies the output current averaged with respect to an image switching cycle.

4. The light emitting element drive device according to claim 3, wherein the power supply controller supplies the output current averaged with respect to the image switching cycle when duty per image switching cycle changes in the load current.

5. The light emitting element drive device according to claim 3, wherein the power supply controller supplies the output current averaged with respect to the image switching cycle when a peak current per image switching cycle changes in the load current.

6. The light emitting element drive device according to claim 3, wherein the power supply controller supplies the output current averaged with respect to the image switching cycle when duty of a high-frequency dimmer in a lighting period per image switching cycle changes in the load current.

7. The light emitting element drive device according to claim 1, wherein the power supply controller includes a switching power supply section that includes a switch element allowing adjustment of a flowing peak current according to a signal to a control terminal and changes the output current depending on magnitude of the peak current to supply output power according to the adjustment to one end side of the light emitting section, and a control section, the control section including a feedback amplifier that obtains an error voltage between the connection node voltage of one connection node between the other end side of the light emitting section and the reference potential and a reference voltage set in advance, a feed-forward section that changes the error voltage obtained by the feedback amplifier in association with the load current information supplied, and a pulse converter that outputs, to the control terminal of the switch element, a signal with a pulse width yielding the peak current that flows through the switch element and is in proportional to the error voltage changed by the feed-forward section.

8. The light emitting element drive device according to claim 7, wherein the pulse-like lighting signal supplied to the switch section of the driver includes a blinking signal to light the light emitting section according to the predetermined cycle, and a lighting signal to adjust brightness, and the feed-forward section of the power supply controller changes the error voltage obtained by the feedback amplifier according to the lighting signal supplied to adjust brightness.

9. A light emitting element drive method carried out in a light emitting element drive device including a light emitting section having a light emitting element that emits light with luminance depending on a flowing current, output capacitance capable of storing power supplied to the light emitting section, a driver that is connected between an other end side of the light emitting section and a reference potential and includes a switch section whose conductive state is controlled by a pulse-like lighting signal depending on magnitude of a load current and a constant current source section connected in series to the switch section, the driver performing impulse driving of the light emitting section in association with the lighting signal, and a power supply controller that is a power supply that provides drive power to one end side of the light emitting section and includes a function to adjust an output current supplied to the output capacitance by a signal depending on a connection node voltage of one connection node between the other end side of the light emitting section and the reference potential, the method comprising changing the supply amount of the output current for the light emitting section from the power supply controller based on load current information that is necessary peak power of the light emitting section in impulse driving of the light emitting section on a predetermined cycle in the light emitting element drive device.

10. The light emitting element drive method according to claim 9, wherein the output current to be supplied is changed based on information on magnitude of a next load current at a stage previous to switching of the load current.

11. The light emitting element drive method according to claim 9, wherein the output current averaged with respect to an image switching cycle is supplied.

12. The light emitting element drive method according to claim 11, wherein the output current averaged with respect to the image switching cycle is supplied when duty per image switching cycle changes in the load current.

13. The light emitting element drive method according to claim 11, wherein the output current averaged with respect to the image switching cycle is supplied when a peak current per image switching cycle changes in the load current.

14. The light emitting element drive method according to claim 11, wherein the output current averaged with respect to the image switching cycle is supplied when duty of a high-frequency dimmer in a lighting period per image switching cycle changes in the load current.

15. A display apparatus comprising:

a display section;

an illuminating unit configured to have a light emitting section including a light emitting element that emits light with luminance depending on a flowing current and irradiate the display section with emitted light; and a light emitting element drive device configured to drive the light emitting element in the light emitting section, wherein the light emitting element drive device includes the light emitting section including the light emitting element that emits light with luminance depending on the flowing current, output capacitance capable of storing power supplied to the light emitting section, a driver that is connected between an other end side of the light emitting section and a reference potential and includes a switch section whose conductive state is controlled by a pulse-like lighting signal depending on magnitude of a load current and a constant current source section connected in series to the switch section, the driver performing impulse driving of the light emitting section in association with the lighting signal, and a power supply controller that is a power supply that provides drive power to one end side of the light emitting section and includes a function to adjust an output current supplied to the output capacitance by a signal depending on a connection node voltage of one connection node between the other end side of the light emitting section and the reference potential, the power supply controller changing the supply amount of the output current for the light emitting section from the power supply controller based on load current information that is necessary peak power of the light emitting section in impulse driving of the light emitting section on a predetermined cycle.

* * * * *